US005715721A

United States Patent [19]

Anders et al.

[11] Patent Number: 5,715,721

[45] Date of Patent: Feb. 10, 1998

[54] FLOATING FORMING DIE

[75] Inventors: Bobby E. Anders, Wichita; Russell L. Mill, Derby; Thomas E. Rudd, Wichita, all of Kans.

[73] Assignee: The Boeing Company, Seattle, Wash.

[21] Appl. No.: 442,239

[22] Filed: May 15, 1995

[51] Int. Cl.[6] ..... B21D 5/02; B21D 19/12

[52] U.S. Cl. ..... 72/311; 72/316; 72/447; 72/473; 72/404

[58] Field of Search ..... 72/309, 308, 316, 72/359, 354.6, 358, 447, 448, 335, 327, 311, 351, 404, 473

[56] References Cited

U.S. PATENT DOCUMENTS

| | | | |
|---|---|---|---|
| 851,630 | 4/1907 | Sloman | 72/473 |
| 3,600,927 | 8/1971 | Wahler | 72/361 |
| 3,768,295 | 10/1973 | Cudzik | 72/347 |
| 4,442,691 | 4/1984 | Grow | 72/329 |
| 4,550,585 | 11/1985 | Sasaki | 72/351 |

FOREIGN PATENT DOCUMENTS

| | | | |
|---|---|---|---|
| 584935 | 12/1977 | U.S.S.R. | 72/473 |

*Primary Examiner*—Daniel C. Crane

*Attorney, Agent, or Firm*—Lawrence W. Nelson; J. Michael Neary

[57] ABSTRACT

Flanges are forming simultaneously around multiple holes in a sheet metal part with a press in which multiple sets of tooling are mounted on a pair of plates fastened to the top and bottom platens of the press. The plates have guides for ensuring that the plates, and the tooling on the plates, are aligned when the plates are brought together by closing the press. The tooling includes dies attached to die holders on the upper plate, and punches attached to punch holders on the lower plate using attachments that permit a small lateral movement of the dies and the punches on their holders so that the punches can self-align with the holes in the part when the part is fit onto the punches, and so that the dies can self-align with the punches when the press closes. A sheet metal part having multiple holes is placed in the press on top of the punches, and the part is moved laterally to shift some of the punches laterally to self-align with the holes in the part and allow the part to settle onto the punches, with upper tapered portions of the punches extending upwardly through the holes in the part. With the part fully settled onto the punches, the press is closed slowly, bringing the annular dies down over the upper tapered portions of the punches. The dies self align with the centerline of the punches and the press is then operated to form the flanges around the holes by the interaction of the dies and punches on opposite sides of the sheet metal part.

21 Claims, 7 Drawing Sheets

FLOATING FORMING DIE

This invention relates to metal forming equipment, and more particularly to a tooling system used in a press for simultaneously forming flanges around multiple holes in a metal sheet with a single stroke of the press.

BACKGROUND OF THE INVENTION

Throughout industry, and in the aerospace industry in particular, lightening and access holes in sheet metal parts are used extensively to reduce weight and concentrate the strength of the part where it is needed, and also to provide for passage of cables, hoses, structural parts, etc. through the sheet metal part. To enhance the structural integrity and rigidity of the sheet metal part, it is common practice to form flanges around these holes.

Forming flanges in sheet metal parts is normally performed in a break press using forming tools including a die, usually on the lower platen of the press, and a vertically aligned annular punch on the upper platen. The die includes a center upright onto which the hole in the sheet metal part is placed. The center upright flares in a smooth curve to a larger diameter at its base, which corresponds to the shape of the matching punch on the upper platen. When the press is closed, the annular punch moves down around the center die upright and forces the margins around the hole in the sheet metal part down onto the flaring region of the die, forming the flange. When the press opens, a spring-loaded stripper ring around the die pushes the part up away from the flaring region of the die to facilitate removal of the part off the die and out of the press.

The conventional hole flange forming process practiced for many years gave rise to numerous problems. Each different hole size on the sheet metal part required that a different matched pair of tooling be installed and aligned in the press, requiring substantial tooling set-up time. Because only one hole was being flanged at a time, the sheet metal part would be supported only at that one place unless complicated supplemental supports were provided. Large parts could require three or four workers to move the part onto and off of the die, resulting in significant labor costs. The uneven support of the part during flanging forming and the one-at-a-time forming process often resulted in warping or other distortions of the part, thereby requiring subsequent corrective steps to restore the part to its desired planar configuration, and adding additional cost to the manufacturing process.

Thus, there has long been a need in the art for a process and apparatus for forming flanges around holes in a sheet metal part that is fast, saves labor and does not cause distortion of the part.

SUMMARY OF THE INVENTION

Accordingly, it is an object of this invention to provide an improved process for forming flanges around multiple holes in a sheet metal part. Another object of this invention is to provide an improved process for simultaneously forming multiple hole flanges in a sheet metal part with a single stroke of a forming press. Still another object of this invention to provide an improved process for simultaneously forming multiple hole flanges in a sheet metal part, to produce a part that is superior in quality and substantially less costly in terms of labor hours per part, press time, and tooling set-up time. A further object of this invention is to provide an improved apparatus for simultaneously forming multiple hole flanges in a sheet metal part. A still further object of this invention is to provide an improved apparatus for simultaneously forming multiple hole flanges in a sheet metal part, using less manpower, less press time and shorter aggregate tooling set-up time. Another still further object of this invention is to provide an improved sheet metal part having multiple flanged holes formed simultaneously and without deforming the sheet during the flange forming operation.

These and other objects are attained in method and apparatus for simultaneously forming flanges around multiple holes in a sheet metal part, including mounting multiple sets of tooling on a pair of plates fastened to the top and bottom platens of a press. The plates have guides for ensuring that the plates, and the tooling on the plates, are aligned when the plates are brought together by closing the press. The tooling includes dies attached to die holders on the upper plate, and punches attached to punch holders on the lower plate using attachments that permit a small lateral movement of the dies and the punches on their holders so that the punches can self-align with the holes in the part when the part is fit onto the punches, and so that the dies can self-align with the punches when the press closes. In operation, a sheet metal part having multiple holes therethrough is placed in the press on top of the punches, and the part is moved laterally to allow the part to settle onto the punches, with upper tapered portions of the punches extending upwardly through the holes in the part. In the process, some of the punches will move laterally to self-align with the holes in the part. With the part fully settled onto the punches, the press is closed slowly, bringing the annular dies down over the upper tapered portions of the punches. The dies self align with the centerline of the punches and the press is then operated to form the flanges around the holes by the interaction of the dies and punches on opposite sides of the sheet metal part.

DESCRIPTION OF THE DRAWINGS

The invention and its many attendant objects and advantages will become better understood upon reading the following description of the preferred embodiment in connection with the following drawings, wherein.

DESCRIPTION OF THE PREFERRED EMBODIMENT

Figure 1:
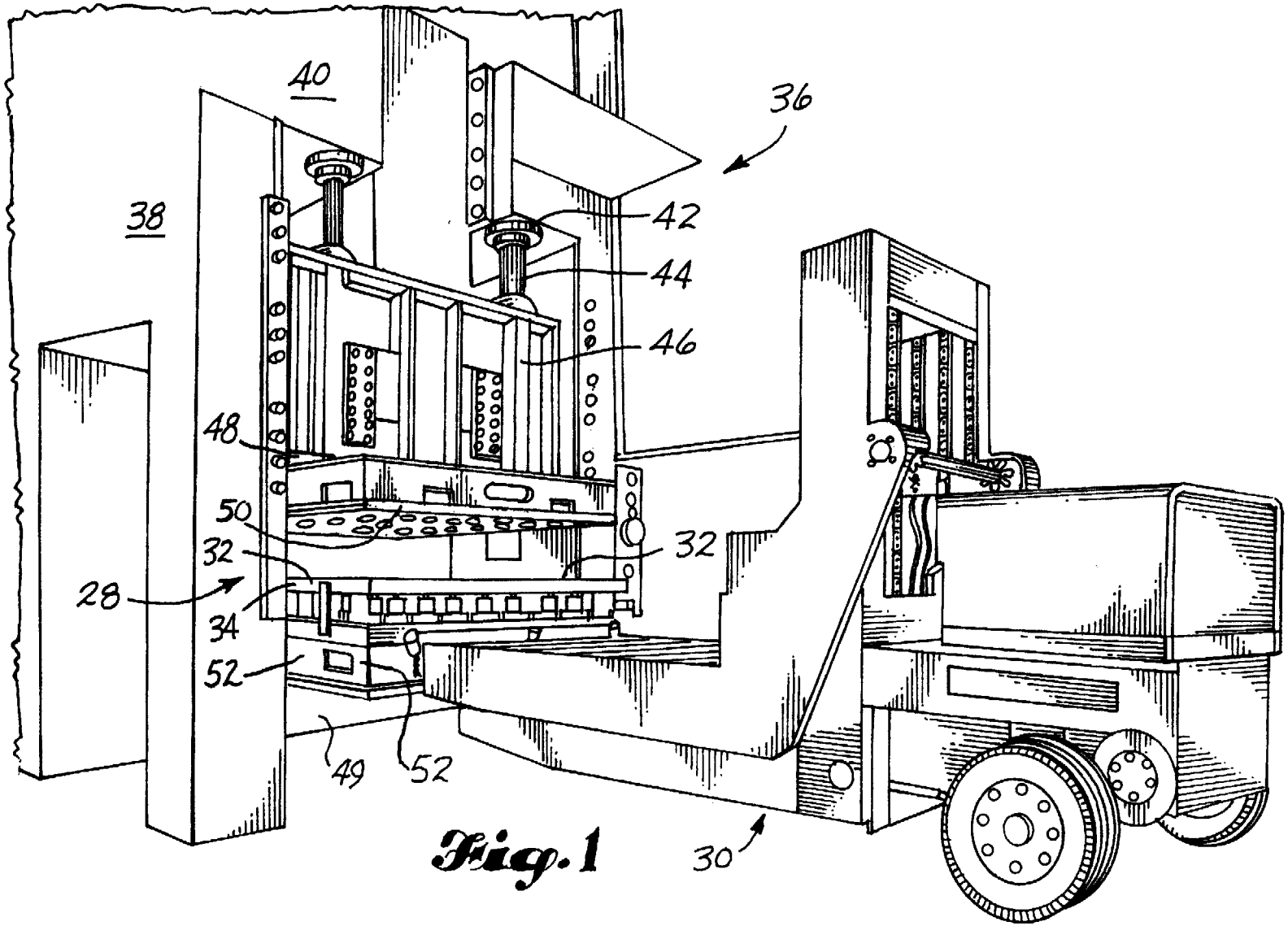
FIG. 1 is a perspective view of a press and a tool loader shown loading upper and lower plates on which the dies and punches are attached for forming hole flanges in accordance with this invention.

Turning now to the drawings, wherein like reference characters designate identical or corresponding parts, and more particularly to FIG. 1 thereof, an apparatus is shown for simultaneously forming flanges 20 around multiple holes 22 in a sheet metal part 24 in a single operation. The apparatus includes tooling 28, shown being loaded by a tool transport and loading device 30 into a press 36. The tooling includes a pair of upper and lower plates 32 and 34, on which are attached a multiplicity of matched forming members, to be described in detail below. The press is a conventional design such as a hydraulic press made by the Clearing Company, having a frame 38 with a top cross member 40 supporting several hydraulic cylinders 42 in which hydraulic pistons 44 are mounted for controlling vertical movement and exerting vertical force on of a ram 46. The bottom face of the ram 46 is a flat platen 48 having attachment points for tooling. A bottom platen 49, which is typically immobile and is supported on the floor, is vertically aligned with the upper platen 48. In this application, the platens 48 and 49 are too small for the plates 32 and 34, so an upper auxiliary platen 50 and a lower auxiliary platen 52 are attached to the upper platen 48 and the lower platen 49, respectively. The auxiliary platens 52 and 54 are steel constructions having sufficient stiffness to transfer the load exerted by the upper and lower platens 48 and 49 to the outer edges of the auxiliary platens 50 and 52 without significant deflection.

The upper and lower plates 32 and 34 are attached to the auxiliary platens 50 and 52 by bolts 54 in stepped holes 56 in the upper and lower plates 32 and 34 and threaded into threaded receptacles (not shown) in the upper and lower auxiliary platens 50 and 52.

Figure 2:
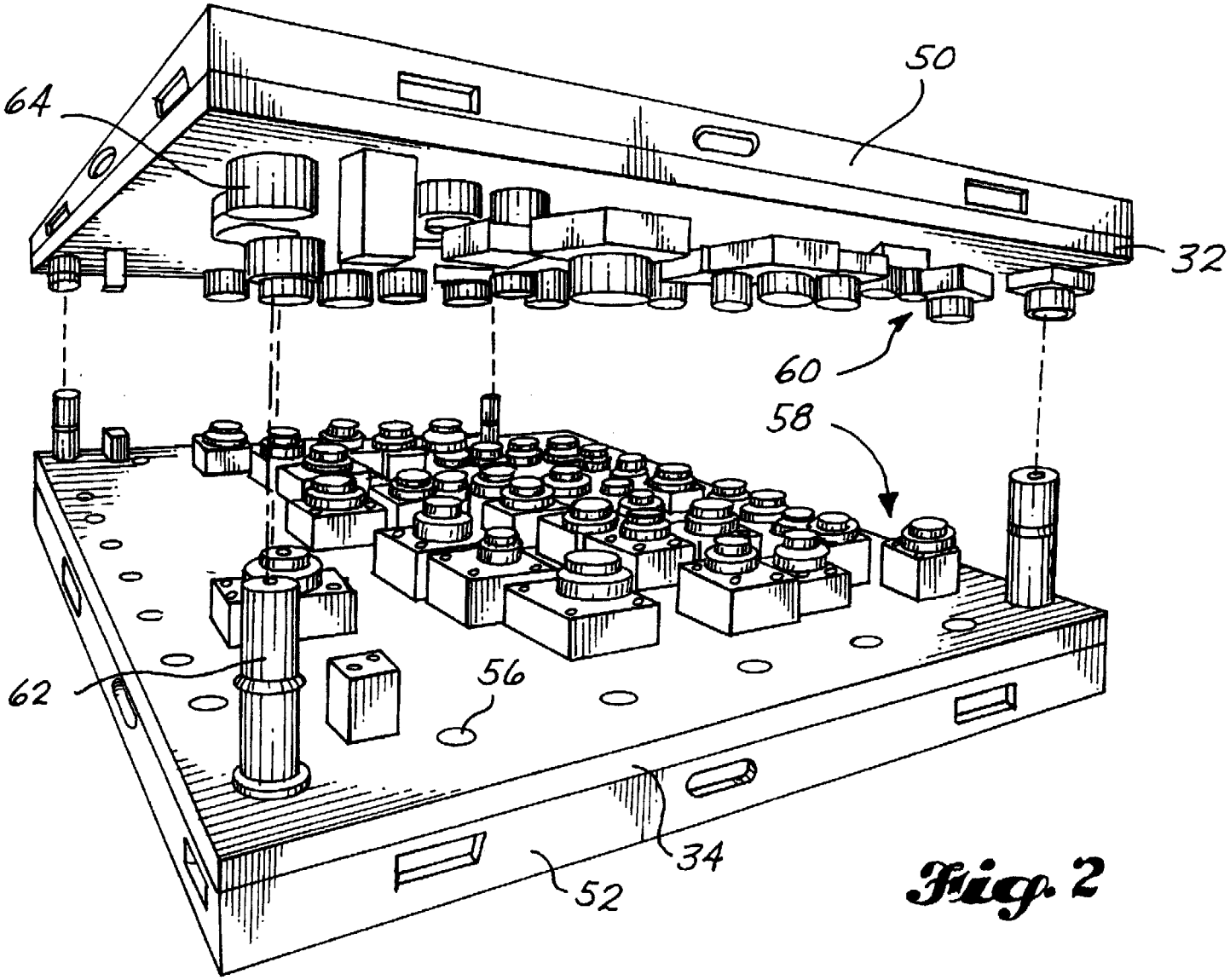
FIG. 2 is a perspective view of the upper and lower plate, with attached dies and punches, connected to the supplemental platens shown in FIG. 1.

Turning now to FIG. 2, the of pairs of forming members are shown vertically aligned and attached to the upper and lower plates 32 and 34. Each pair of forming members includes a punch assembly 58 attached to the lower plate 34 and a die assembly 60 attached to the upper plate 52. The punch and die assemblies are attached by machine screws 61 to the plates 32 and 34 and, once positioned accurately on the plates, are maintained in that tooling assembly for future use for making the part for which that tooling was designed. Thus, after the punches and dies 58 and 60 are attached to the plates 34 and 32, there is no future need to perform tooling setup for the making of additional parts of that design, except for loading the tooling assembly including the two plates 32 and 34 and the attached dies and punches into the press 36.

A guide structure is attached to the upper and lower plates 32 and 34 to ensure alignment of the plates and the attached forming members 58 and 60 when they come together to form the flanges on the part. The guide structure includes a guide post 62 attached to the lower plate 34 and a guide bushing 64 attached to the upper plate 32. Both the guide post 62 and the guide bushing 64 are pressed into tight fitting bores machined into the plates 34 and 32, and are held in place by angle clamps 66 secured by machine screws 68. The guide bushing 64 has an axial cylindrical opening which is sized to receive the guidepost 62 and align the die plates 32 and 34 vertically when the guide post 62 enters the guide bushing 64. A chamfer on the top edge of the guidepost 62 facilitates entry of the guidepost 64 into the vertical cylindrical opening in the bushing 64 as the guidepost 62 enters the bushing 64.

Figure 3:
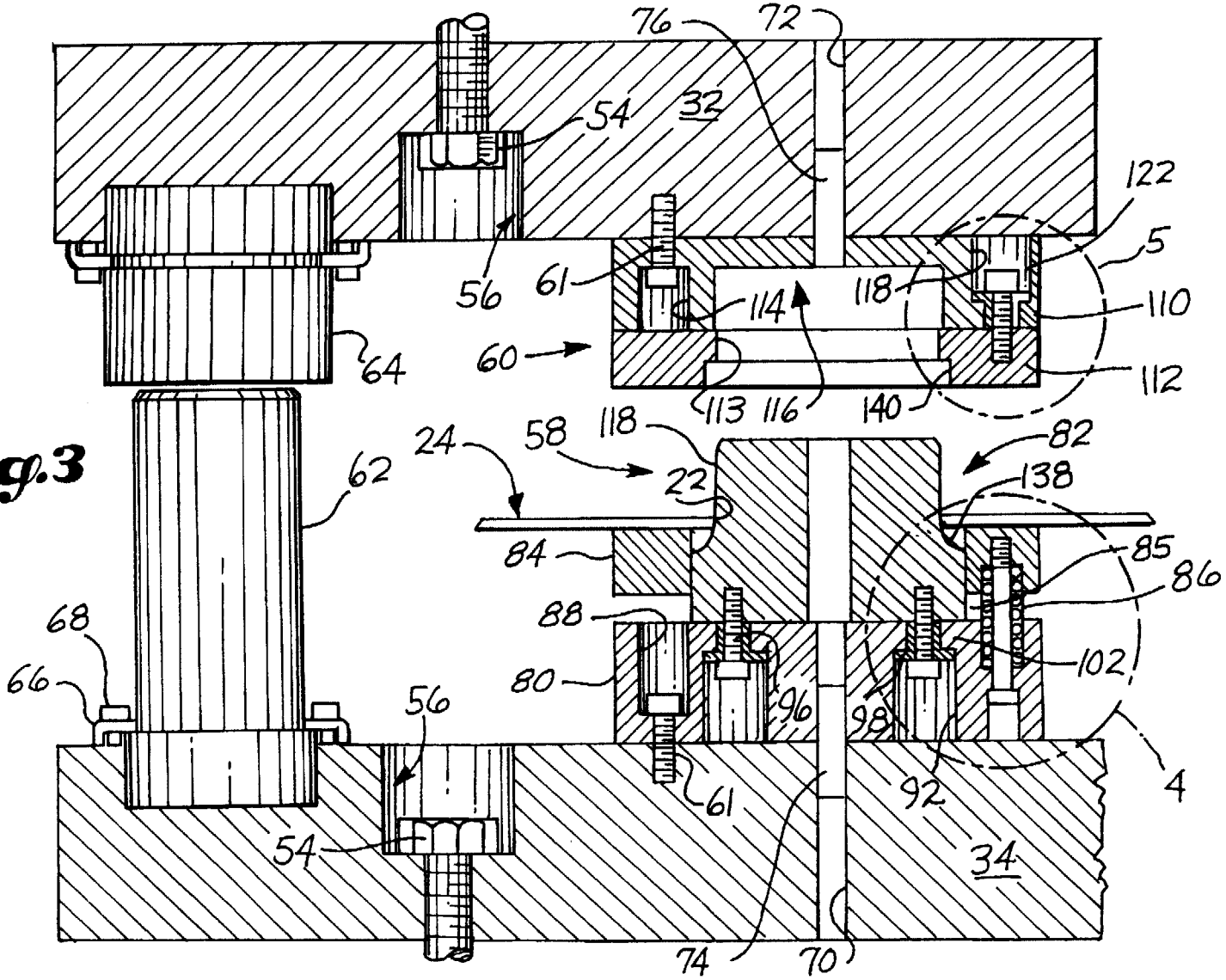
FIG. 3 is an elevation, partly in section, of a portion of the upper and lower plates with one pair of forming members and guide structure attached to the plates, showing a portion of a workpiece placed on the punch in preparation for forming.

The die assemblies 60 and punch assemblies 58, shown in detail in FIG. 3, are positioned accurately on the plates 32 and 34 respectively on the center line of the holes through the sheet metal part being flanged by this apparatus. The positioning of the punch assemblies 58 and the die assemblies 60 is accomplished by accurately drilling locating holes 70 in the lower plate 34 on the center line of the holes in the sheet metal part, and corresponding holes 72 through the upper plate 32 on the same center lines. Locating pins 74 and 76 are set in the location holes 70 and 72 to facilitate accurate placement of the punch assembly 58 and the die assembly 60, as described below.

Figure 4:
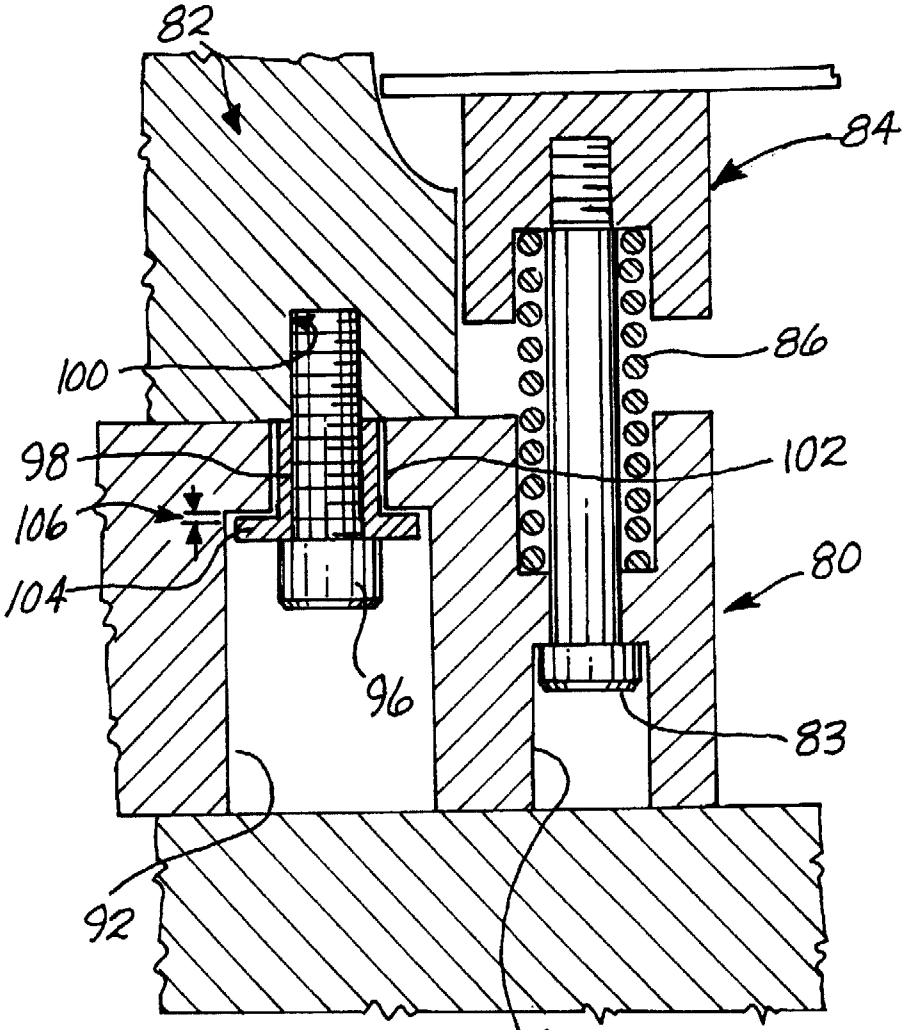
FIG. 4 is an enlarged view on the region 4 in FIG. 3.

The punch assembly 58 includes a punch holder 80 to which is attached a punch 82, and an annular stripper ring 84 surrounding a lower cylindrical base portion 85 of the punch 82 and attached to the punch holder 80 by screws 83 extending through stepped holes 81 in the punch holder and threaded into tapped holes in the under surface of the stripper rings 84. The stripper rings 84 are biased upwardly away from the punch holder 80 by resilient structure such as elastomeric pads, pneumatic cylinders or, as shown in FIG. 3, compression springs 86 seated in wells 87 in the top of the punch holder 80 and compressed and restrained therein against the underside of the stripper rings 84. The screws 83 limit the upward movement of the stripper rings to the height shown in FIGS. 3 and 4, but permit the stripper ring to be pushed down by the die 112, as shown in FIG. 7, when the flange 20 is being formed. The punch holder 80 is in the form of a square block having a stepped hole 88 in each corner for receiving the machine screws 61 which are threaded into tapped holes in the lower plate 34 and by which the punch holder 80 is secured to the lower plate 34. The stepped holee 88 are radially outside of the stripper rings 84, as shown in FIG. 2, and are not vertically aligned with the stripper rings 84, which the perspective of FIGS. 3 and 6–8 would indicate. Therefor, the screws 61 are accessible to torquing tools when attaching the punch and die assemblies 58 and 60 to the lower and upper plates 34 and 32.

A second series of stepped holes 92 drilled into the bottom of the punch holder 80 receives fasteners 96 for attaching the punches 82 to the punch holders 80. The attachment of the punches 82 to the punch holders 80 enables a small lateral movement or floating of the punches 82 relative to the punch holders 80 which are fixed to the lower plate 34 by the machine screws 61 and the locating pins 74. As shown in FIG. 3 and more detail in FIG. 4, the fasteners attaching the punch 82 to the punch holder 80 include machine screws 96 extending through flanged bushings 98 and threaded into tapped holes 100 in the under side of the punches 82. The dimension of the bushing 98 relative to the shoulder portion 102 at the junction of the wide diameter portion and the narrow portion of the stepped hole 92 provides a clearance for the lateral movement of the punch 82 on the punch holder 80. Specifically, the total axial length of the bushing 98 is selected to leave a gap 106 between the under side of the bushing flange 104 and the shoulder 102, and the outside diameter of the bushing 98 is slightly smaller than the inside diameter of the narrow portion of the stepped hole 92 in the punch holder 80, leaving a radial gap 108 between the outside surface of the bushing and the inside surface of the narrow portion of the hole 92. The bushing 98 enables the machine screw 96 to be screwed tightly into the tapped hole 100 in the punches 82 while maintaining the lateral and vertical clearance which will enable the punches 82 to move laterally on the punch holders 80.

Other fasteners that perform the same function could be used instead of the machine screws 96 and the bushings 98. For example, shoulder bolts of known construction, which are effectively a single piece version of the screw 96 and the bushing 98, could be used in place of the two piece construction shown. Likewise, the hole 92 could be drilled in the punch 82 and the screw 96 could be threaded into a tapped hole in the punch holder 80.

The mounting of the die assemblies 60 on the upper plate 32 is identical to that described for the punch assemblies 58 on the lower plate 34. The die assembly 60 includes a die holder 110 to which is attached an annular die 112, having an axial opening 113 therethrough. The die holder 110 is in the form of a square block having stepped holes 114 in each corner for receiving the machine screws 61 which are threaded into tapped holes in the upper plate 32 and by which the die holder 110 is secured to the upper plate 32. A central recess 116 in the die holder 110 aligned with the axial opening 113 in the die 112 accommodates nesting of an upper tapered portion 118 of the punch 82 into the annular die 112 and the die holder 110 in operation, as described below. Suitable openings (not shown) are provided through the die 112 for access to the screws 61.

Figure 5:
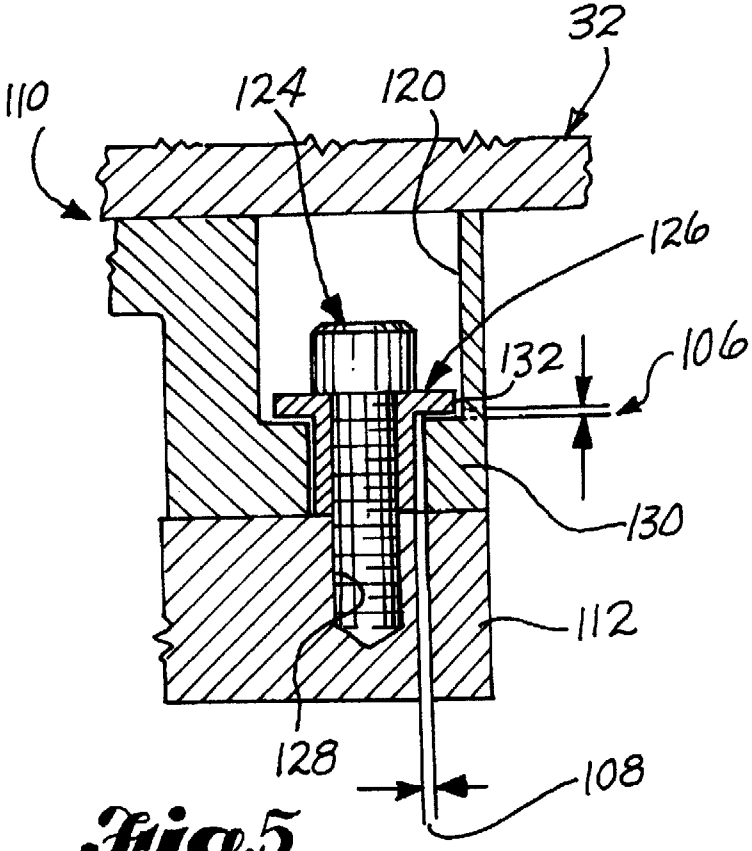
FIG. 5 is an enlarged view of the region 5 in FIG. 4

A second series of stepped holes 120 drilled into the bottom of the die holder 110 receives fasteners 122 for attaching the dies 112 to the die holders 110. The attachment of the dies 112 to the die holders 110 is such as to enable a small lateral movement or floating of the dies 112 relative to the die holders 110 which are fixed to the upper plate 32 by the machine screws 61 and the locating pins 76. As shown in FIG. 3 and more detail in FIG. 5, the fasteners 122 attaching the dies 112 to the die holders 110 include machine screws 124 extending through flanged bushings 126 and threaded into tapped holes 128 in the under side of the dies 112. The dimension of the bushings 126 relative to the shoulder portion 130 at the junction of the wide diameter portion and the narrow portion of the stepped hole 120 provides a clearance for the lateral movement of the die 112 on the die holder 110. Specifically, the total axial length of the bushing 126 is selected to leave a gap 106 between the under side of the bushing flange 132 and the shoulder 130, and the outside diameter of the bushing 126 is slightly smaller than the inside diameter of the narrow portion of the stepped hole 120 in the die holder 110, leaving a radial gap 108 between the outside surface of the bushing and the inside surface of the narrow portion of the hole 120. The bushing 126 enables the machine screw 124 to be screwed tightly into the tapped hole 128 in the dies 112 while maintaining the lateral and vertical clearance which will enable the dies 112 to move laterally on the die holders 110.

Other fasteners that perform the same function could be used instead of the machine screws 124 and the bushings 126. For example, shoulder bolts of known construction, which are effectively a single piece version of the screw 124 and the bushing 126, could be used in place of the two piece construction shown. Likewise, the hole 120 could be drilled in the die 112 and the screw 124 could be threaded into a tapped hole in the die holder 110, although the hole would require radiusing at the part contact surface to prevent marking of the part by the opening to the hole in the die surface.

In operation, the location of holes in the sheet metal part is replicated on the upper and lower plates and the locating holes 70 and 72 are drilled in the plates 34 and 32. Locating pins 74 and 76 are set into the holes 70 and 72, and in the punch assemblies 58 and die assemblies 60 are set on the pins 74 and 76, respectively, by way of axial holes 134 and 136 in the punch holders 80 and the die holders 110. The holders 80 and 110 are secured to the plates 34 and 32 by the screws 61 and the assembled tooling 28 is loaded into the press using the tool transport and loading tool 30. The plates 32 and 34 are attached to the auxiliary platens 50 and 52 and the press 36 is opened to receive the sheet metal part 24.

The part, which in the example has 58 holes, is lubricated in the usual manner to protect the part and the tooling and otherwise facilitate forming, and is moved around laterally to cause the upper tapered portions 118 of the punches 82 to protrude through the holes 22 in the part 24. A chamfer at the upper end of the upper tapered portion of the punch facilitates nesting of the part onto the punches.

In the process of shifting and jiggling the part on the punches, the punches are moved slightly by engagement of the tapered surface of the upwardly extending tapered portion 118 with the peripheral edges of the holes 22 in the part 24, causing the punches to move laterally and self align with the holes 22 as the part drops down in a nested position on the punches. The clearance 108 is set at the positional tolerance limit of the centerline of the holes on the sheet metal part 24 which ensures that the part 24 will fit over the punches.

Once the part 24 is nested onto the punches 82, the press is closed slowly, bringing the upper plate 32 down and bringing the openings 113 in the dies 112 down over the upwardly projecting tapered portion 118 of the punches 82. The inner peripheral edges of the openings 113 engage the tapered surface of the upward extension 118 of the punches and move the dies 82 laterally to self-align with the punches 82.

Figure 6:
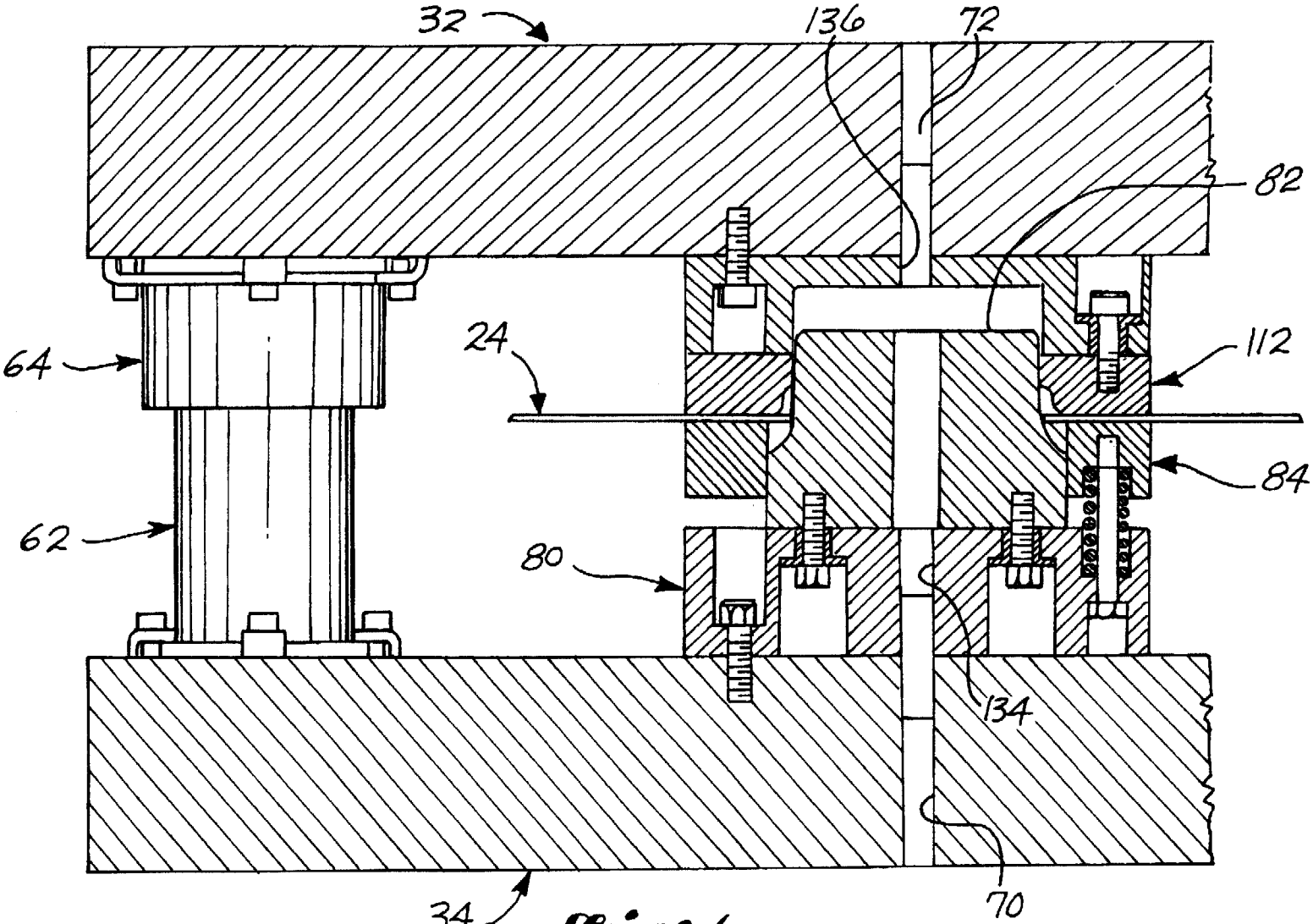
FIG. 6 is an elevation of the structure shown in FIG. 3, with the press closed far enough to bring the die on the upper plate into contact with the workpiece.
Figure 7:
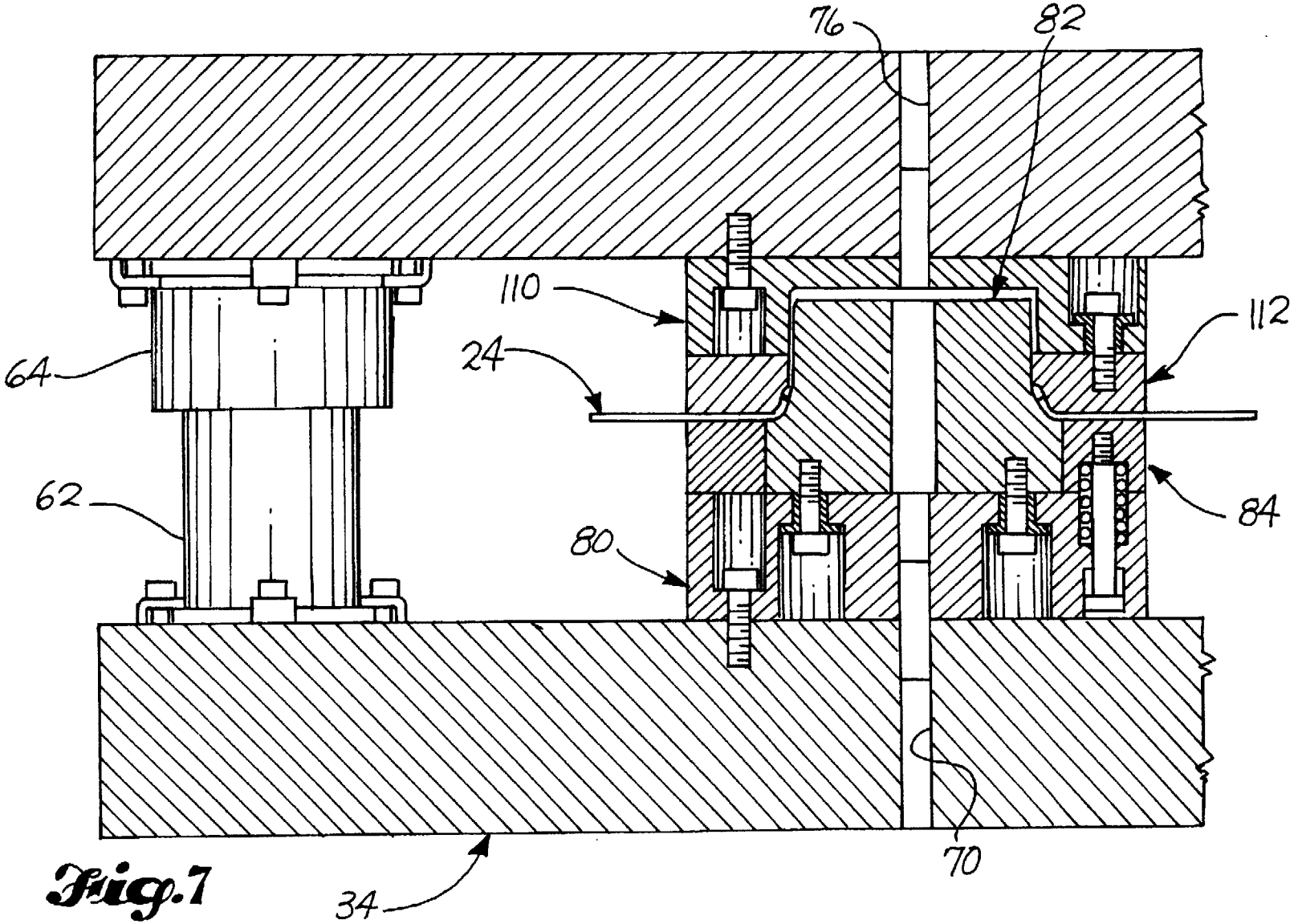
FIG. 7 is an elevation of the structure shown in FIG. 3, with the press closed far enough to form a flange on the workpiece.

The press continues to close and when the bottom surface of the dies 112 reach the upper surface of the part 24 as shown in FIG. 6, the stripper rings clamp the part 24 against the dies with a clamping pressure equal to the combined spring force of the springs 86. Typically, there are 6–10 compression springs around each punch bearing on each stripper ring, so the combined clamping force holding the part flat against the flat lower surfaces of the dies is substantial and is sufficient to maintain the planar condition of the sheet metal part 24 during and after formation of the flanges 20.

Figure 8:
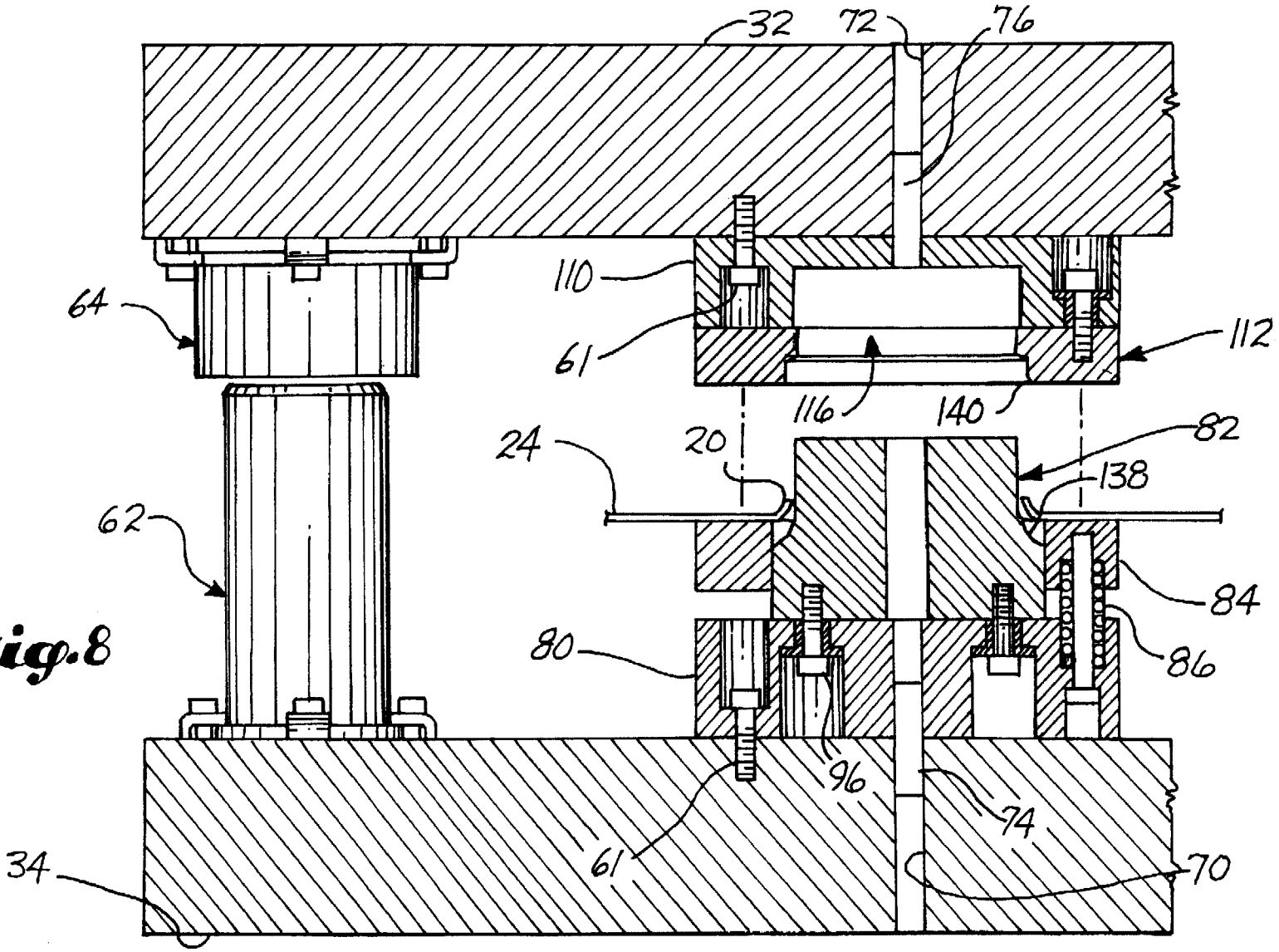
FIG. 8 is an elevation of the structure shown in FIG. 3, with the press opened after forming the flanges, and the workpiece lifted off of the forming surfaces of the punch.

The press continues to close, compressing the compression springs 86 and driving the part downward onto flared forming surfaces 138 on the punches 82 at the junction of the upwardly extending portion 118 and the lower base portion 85. The die 112 has complementary forming surfaces 140 at the lower peripheral edge of the opening 113 which cooperate with the forming surfaces 138 on the punches to form the flanges. The press exerts the force to which it is set, about 450 tons in the example of a 58 hole part, and forms the flange as shown in FIG. 7. The press is then opened as shown in FIG. 8 and the stripper rings lift the part upward, clear of the forming surfaces 138 on the punches. The operator lifts the part off the punches and slides it out of the press and onto a waiting portable table, from which it can to removed to a staging area for formed pans in the factory.

Obviously, numerous modifications and variations of the preferred embodiment disclosed herein will occur to those skilled in the art. Accordingly, it is to be understood that the practice of these modifications and variations, and the equivalents thereof, would be within the spirit and scope of the invention as defined in the following claims, wherein we claim:

1. A method for simultaneously forming flanges around multiple holes in a planar sheet metal part, comprising:

placing said sheet metal part on top of a multiplicity of punches, one for each hole to be flanged, held in punch holders attached to a punch plate, said punches having upper portions smaller in diameter than said holes;

moving said part to align said punches with said holes in said sheet while moving said punches lateral to said punch holders to self-align with said holes in said part;

moving a multiplicity of annular dies, each held in a die holder attached to a die plate, downward over said punches, said annular dies each having a central opening larger in diameter than said upper portions of said punches;

moving said dies lateral to said die holders to self-align with said punches during vertical motion to bring said punches and said dies together so that said dies are aligned with said punches before said dies engage said sheet metal part; and pressing said punches and said dies against said sheet metal part on marginal regions around said holes and deforming said marginal regions into flanges that project outwardly from the plane of said sheet metal part.

2. A method as defined in claim 1, further comprising:

supporting said die plate and said punch plate on upper and lower platens of a press, and operating said press to move said plates together to perform said downward moving step.

3. A method as defined in claim 2, further comprising:

guiding said plates to move in vertical alignment during at least a portion of said press operation.

4. A method as defined in claim 1, wherein:

said punch lateral moving step includes engaging said upper portion of said punches with peripheral edges of said holes and pushing said punches laterally with said peripheral edges of said holes to align said punches in said holes.

5. A method as defined in claim 1, wherein:

said die lateral moving step includes engaging peripheral edges of said center openings of said dies with said upper portion of said punches, and pushing said dies laterally with said punches as said dies descend onto said punches to align said dies on said punches.

6. A method as defined in claim 1, further comprising:

supporting said sheet metal part on a plurality of stripper rings, one each surrounding each of said punches.

7. A method as defined in claim 6, further comprising:

clamping said sheet metal part against said dies with said stripper rings during forming of said flanges;

whereby said sheet metal part is clamped between said holes in said planar condition during formation of said hole flanges by said dies and said punches to prevent deformation of said sheet metal part between said holes out of said planar condition.

8. For use in a press having upper and lower platens and a powered mechanism for moving said platens forcefully toward and away from each other, an apparatus for simultaneously forming flanges around multiple holes in a sheet of metal, comprising:

an upper plate and a lower plate, said plates having attachment structure for attaching said plates to said upper and lower platens, respectively;

a guide structure having parts attached to said plates for aligning said plates when said upper and lower platens are moved to bring said parts of said guide structure into contact;

forming member pairs attached to said upper and lower plates, each of said forming member pairs including a punch in a punch holder attached to one of said upper and lower plates, and an annular die in a die holder attached to the other of said upper and lower plates, said punch being attached to said punch holder with fasteners that allow said punch to move laterally to self-align with a hole when said punch enters said hole in said sheet;

said die being attached to said die holder with fasteners that allow said die to move laterally, when said punch enters said die, to self align with said punch;

whereby, when said sheet is placed in said press on said punches and moved to align said punches with said holes in said sheet, said punches float laterally to self-align with said holes when said tapered portion of said punches enter said holes, and said dies self-align with said punches when said press is operated to bring said punches and said dies vertically into contact, so multiple holes in said sheet can be flanged simultaneously in a single stroke of said press.

9. An apparatus as defined in claim 8, wherein:

said fasteners include headed screws extending through holes in said punch holder and threaded into tapped holes in said punch, said holes in said punch holder being stepped holes with an intermediate shoulder where said holes step from a first diameter to a second smaller diameter, said holes having a clearance that allows said punch to move laterally an amount about equal to the manufacturing tolerance in the centerline location of said hole on said sheet, and a clearance between said screw head and said shoulder of said stepped hole in said punch holder that allows said punch to move laterally;

said fasteners further include headed screws extending through stepped holes in said die holder and threaded into tapped holes in said die, said holes in said die holder having a clearance that allows said die to move laterally an amount equal to the manufacturing tolerance in said hole centerline location on said sheet, and a clearance between said screw head and a shoulder of said stepped hole in said die holder that allows said die to move laterally.

10. An apparatus as defined in claim 8, wherein:

said guide structure includes a guide bushing attached to one of said upper and lower plates, and a guide post attached to the other of said upper and lower plates in vertical alignment with said guide bushing;

said guide structure having a vertical height greater than any of said punches, whereby during operation of said press, said guide post enters said guide bushing before said punches enter said dies to ensure alignment of said upper and lower plates and prevent misalignment of said upper and lower forming members.

11. An apparatus as defined in claim 10, wherein:

said guide bushing and said guide post are pressed into cavities machined into said plates.

12. An apparatus as defined in claim 8, further comprising:

locating pins in said punch and die holders, and accurately drilled holes in said punch plates receiving said locating pins and accurately locating said holders on part hole centerlines.

13. An apparatus as defined in claim 12, further comprising:

a vertical pin hole in said punch and die holders for receiving said locating pins, and a vertical access hole in said punches and dies vertically aligned with said vertical pin holes for access to said pin holes.

14. An apparatus as defined in claim 8, further comprising:

stripper rings around punches on said punch holder, said stripper rings biased away from said punch holders.

15. An apparatus as defined in claim 9, further comprising:

bushings around screws holding said punches and dies to allow said screws to be torqued down against said bushings while providing clearance between said screw head and said shoulder to allow said punches and dies to float laterally.

16. An apparatus as defined in claim 8, further comprising:

support blocks on at least one of said punch plates for supporting said upper plate in vertically spaced relationship to said lower plate when said upper plate is disconnected from said press upper platen.

17. A floating forming member pair for use with a plurality of floating member pairs to form flanges around holes in a sheet metal part in a press having upper and lower platens, comprising:

a punch in a punch holder having attachment hardware for attachment to one of said upper and lower platens, and an annular die in a die holder having attachment hardware for attachment to the other of said upper and lower platens, said punch being attached to said punch holder with fasteners that allow said punch to move laterally to self-align with said hole centerline when said punch enters said hole in said sheet;

said die being attached to said die holder with fasteners that allow said die to move laterally, when said punch enters said die, to self align with said punch centerline;

whereby, said sheet metal part may be placed in said press on said punch and moved to align said punch with a hole in said part, and said punch floats laterally to self-align with said hole when an upper portion of said punch enters said hole, and said die self-aligns with said punch when said press is operated to bring said punches and said dies vertically into contact, so a plurality of holes in said part can be simultaneously flanged in a single stroke of said press.

18. A floating forming member pair as defined in claim 17, further comprising:

stripper rings around punches on said punch holder, said stripper rings biased away from said punch holders by resilient structure between said punch holder and said stripper rings.

19. A floating forming member pair as defined in claim 17, wherein:

said fasteners include headed screws extending through holes in said punch holder and threaded into tapped holes in said punch, said holes in said punch holder being stepped holes with an intermediate shoulder where said holes step from a first diameter to a second smaller diameter, said holes having a clearance that allows said punch to move laterally an amount about equal to the manufacturing tolerance in said hole centerline location on said sheet, and a clearance between said screw head and said shoulder of said stepped hole in said punch holder that allows said punch to move laterally;

said fasteners further include headed screws extending through stepped holes in said die holder and threaded into tapped holes in said die, said holes in said die holder having a clearance that allows said die to move laterally an amount equal to the manufacturing tolerance in said hole centerline location on said sheet, and a clearance between said screw head and a shoulder of said stepped hole in said die holder that allows said die to move laterally.

20. A floating forming member pair as defined in claim 19, further comprising:

bushings around screws holding said punches and dies to allow said screws to be torqued down against said bushings while providing clearance between said screw head and said shoulder to allow said punches and dies to float laterally.

21. A pair of tools for forming a flange around a hole in a sheet metal part, for using in a press having upper and lower platens, said tools comprising:

a forming punch having attachment hardware for attachment of said punch to one of said upper and lower platens, and a mating annular die having attachment hardware for attachment to the other of said upper and lower platens;

a holder for holding at least one of said tools for attachment to one of said upper and lower platens;

said one tool being attached to said holder with fasteners that allow said one tool to move lateral to said sheet metal part to self-align with said other tool when said punch enters said annular opening in said die; whereby, a part is placed in said press on said punch and moved to align said punch with a hole in said part, and one of said tools floats lateral to said sheet metal part to self-align with the other of said tools when an upper tapering portion of said punch enters said annular opening in said die and engages peripheral edges of said annular opening with said tapering portions of said upper portion of said punch and exerts a force lateral to said sheet metal part to self-align said one tool with the centerline of said other tool when said press is operated to bring said punches and said dies vertically into contact; and said both of said tools are attached to tool holders with fasteners that allow said tools to move lateral to said sheet metal part when said punch enters said die to self align with each other and said hole in said part; whereby said punch can move lateral to said sheet metal part to self-align with said mating punch when said forming punch engages guide surfaces on said mating punch as said matched punches are brought together to form said part.

* * * * *